US011857088B2

(12) United States Patent
Leia et al.

(10) Patent No.: US 11,857,088 B2
(45) Date of Patent: Jan. 2, 2024

(54) ADJUSTABLE BENCH

(71) Applicant: Ombase Ventures Ltd., Campbell River (CA)

(72) Inventors: Allan Peter Leia, Campbell River (CA); Lisa Ann Pedscalny, Comox (CA); Craig Michael Drummond, Vancouver (CA); Herbert Walter Bentz, Vancouver (CA); Christopher Pond, Vancouver (CA); Michael Foster, Vancouver (CA)

(73) Assignee: Ombase Ventures Ltd.

( * ) Notice: Subject to any disclaimer, the term of this patent is extended or adjusted under 35 U.S.C. 154(b) by 0 days.

(21) Appl. No.: 17/981,356

(22) Filed: Nov. 4, 2022

(65) Prior Publication Data

US 2023/0055838 A1 Feb. 23, 2023

Related U.S. Application Data

(63) Continuation of application No. 16/639,979, filed as application No. PCT/CA2018/051004 on Aug. 17, 2018, now Pat. No. 11,517,114.

(60) Provisional application No. 62/547,661, filed on Aug. 18, 2017.

(51) Int. Cl.

| | |
|---|---|
| ***A47C 9/00*** | (2006.01) |
| ***A63B 21/00*** | (2006.01) |
| ***A47C 16/04*** | (2006.01) |
| ***A47C 3/40*** | (2006.01) |
| ***A63B 71/00*** | (2006.01) |

(52) U.S. Cl.

CPC ..... *A47C 9/002* (2013.01); *A47C 3/40* (2013.01); *A47C 16/04* (2013.01); *A63B 21/4029* (2015.10); *A63B 71/0036* (2013.01); *A63B 2208/0214* (2013.01); *A63B 2225/093* (2013.01)

(58) Field of Classification Search

CPC ..... A47C 9/002; A47C 16/04; A47C 13/00; A47C 9/005; A63B 2208/0214; A63B 21/4029

USPC ..... 297/423.44, 188.09, 188.1

See application file for complete search history.

(56) References Cited

U.S. PATENT DOCUMENTS 2,592,912 A * 4/1952 Knipper ..... A47C 12/02 182/35
2,896,695 A * 7/1959 Ashworth ..... A47C 13/00 297/118
4,871,166 A 10/1989 Sterba et al.
(Continued)

FOREIGN PATENT DOCUMENTS

DE 3640481 A1 * 6/1988 ..... A63B 21/4029
EP 1528950 B1 * 2/2011 ..... A63B 21/00047
(Continued)

OTHER PUBLICATIONS

Notice of Reasons for Refusal re Japanese Patent Application No. 2020-530714; pp. 1-4; dated Jul. 25, 2022.
(Continued)

*Primary Examiner* — Milton Nelson, Jr.

(57) ABSTRACT

An adjustable bench comprises a seat, a skirt extending from the seat, and a plurality of height adjustable leg assemblies coupled to the skirt. The seat is shaped to be selectively mated with the skirt to provide the bench with either a flat top or a sloped top surface.

20 Claims, 13 Drawing Sheets

(56) References Cited

U.S. PATENT DOCUMENTS

| | | | | |
|---|---|---|---|---|
| 5,419,618 | A * | 5/1995 | Hatcher | A47C 16/025 297/423.46 |
| 5,637,059 | A | 6/1997 | Dalebout | |
| 5,697,870 | A | 12/1997 | Osborn | |
| 7,007,328 | B1 | 3/2006 | Bailey | |
| 7,320,502 | B1 | 1/2008 | McCloskey | |
| 7,614,988 | B1 | 11/2009 | Kiser | |
| 2004/0135416 | A1 | 7/2004 | Parker | |
| 2009/0192028 | A1 | 6/2009 | Shank | |
| 2014/0187395 | A1 | 7/2014 | Blahnik et al. | |
| 2016/0192771 | A1 | 7/2016 | Hoff | |
| 2016/0353892 | A1 | 12/2016 | James | |
| 2017/0056708 | A1 | 3/2017 | Kelly | |

FOREIGN PATENT DOCUMENTS

| | | | |
|---|---|---|---|
| JP | 2002-238699 | A | 8/2002 |
| JP | 2011-031018 | A | 2/2011 |
| WO | 2016/084110 | A1 | 6/2016 |

OTHER PUBLICATIONS

International Preliminary Report on Patentability dated Nov. 20, 2019, for International Application No. PCT/CA2018/051004, 9 pages.

Written Opinion of the International Searching Authority dated Dec. 11, 2018, for International Application No. PCT/CA2018/051004, 4 pages.

International Search Report dated Dec. 11, 2018, for International Application No. PCT/CA2018/051004, 4 pages.

Chinese National Intellectual Property Administration, Office Action for Chinese Patent Application No. 2018800536725, dated Jan. 10, 2023, pp. 1-9 (original document) and pp. 1-13 (English translation).

* cited by examiner

ADJUSTABLE BENCH

BACKGROUND OF THE INVENTION

Field of the Invention

The present invention relates to an adjustable bench and, in particular, to an adjustable bench having a seat which may be selectively mated with the skirt to provide the bench with either a flat top surface or a sloped top surface.

Description of the Related Art

U.S. Patent Application Publication No. 2009/0192028 which was published on Jul. 30, 2017, in the name of Shank, discloses a yoga comfort system wedge constructed of medium density, high quality, closed cell foam materials and adhesives comprised of layers and septums which create a uniquely flexible prop. The construction forms a triangularly shaped yoga, fitness, or therapeutic device in the form of a flexible wedge which allows users to achieve or maintain certain poses, stretches, exercises or therapeutic positions while improving tactile comfort and aiding range of motion. The yoga comfort system wedge has advantages over traditional types of yoga, meditation, fitness, or therapy devices. The yoga system wedge allows for users with specific physical limitations to comfortably modify and maintain desired poses or exercises, which would not ordinarily be possible, while at the same time provides for the advanced user to practice their highly skilled activities with greater comfort and ease. Two yoga comfort system wedges can be placed together with similar planar faces adjoining to form a comfortable block or comfort bolster, offering more versatility and applications. A variety of yoga comfort system wedges can also be stacked or arranged to provide additional methods for use.

SUMMARY OF THE INVENTION

There is provided an adjustable bench comprising a seat, a skirt extending from the seat, and a plurality of height adjustable leg assemblies coupled to the skirt. The seat is shaped to be selectively mated with the skirt to provide the bench with either a flat top surface or a sloped top surface. The leg assemblies of the bench may be slidably or telescopically adjustable. The leg assemblies of the bench may be pivotably coupled to the skirt. There may be a strap secured to the leg assemblies of the bench to restrict movement of the leg assemblies. The skirt may include a front apron, a rear apron, and side aprons. The side aprons may each have a respective top edge which slopes downwardly from the rear apron to the front apron. The seat may be generally wedge-shaped and have an apex. The seat may be mated with the skirt with the apex of the seat extending along the rear apron of the skirt or the seat may be mated with the skirt with the apex of the seat extending along the front apron of the skirt. The seat may be removed from the skirt to allow access to a storage compartment. The seat may be mates with the skirt.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
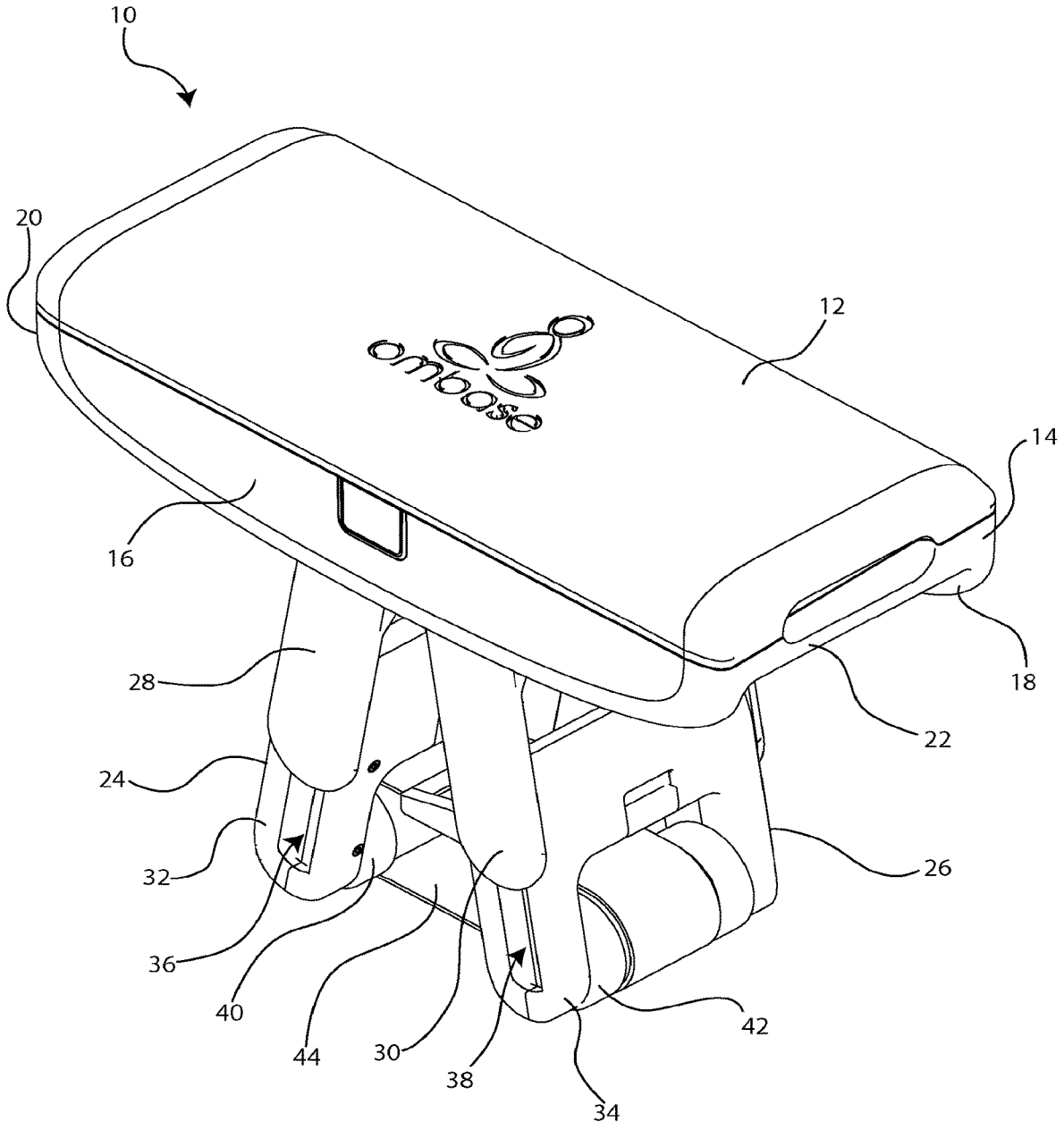
FIG. 1 is a top perspective view of an adjustable bench in a deployed configuration.
Figure 2:
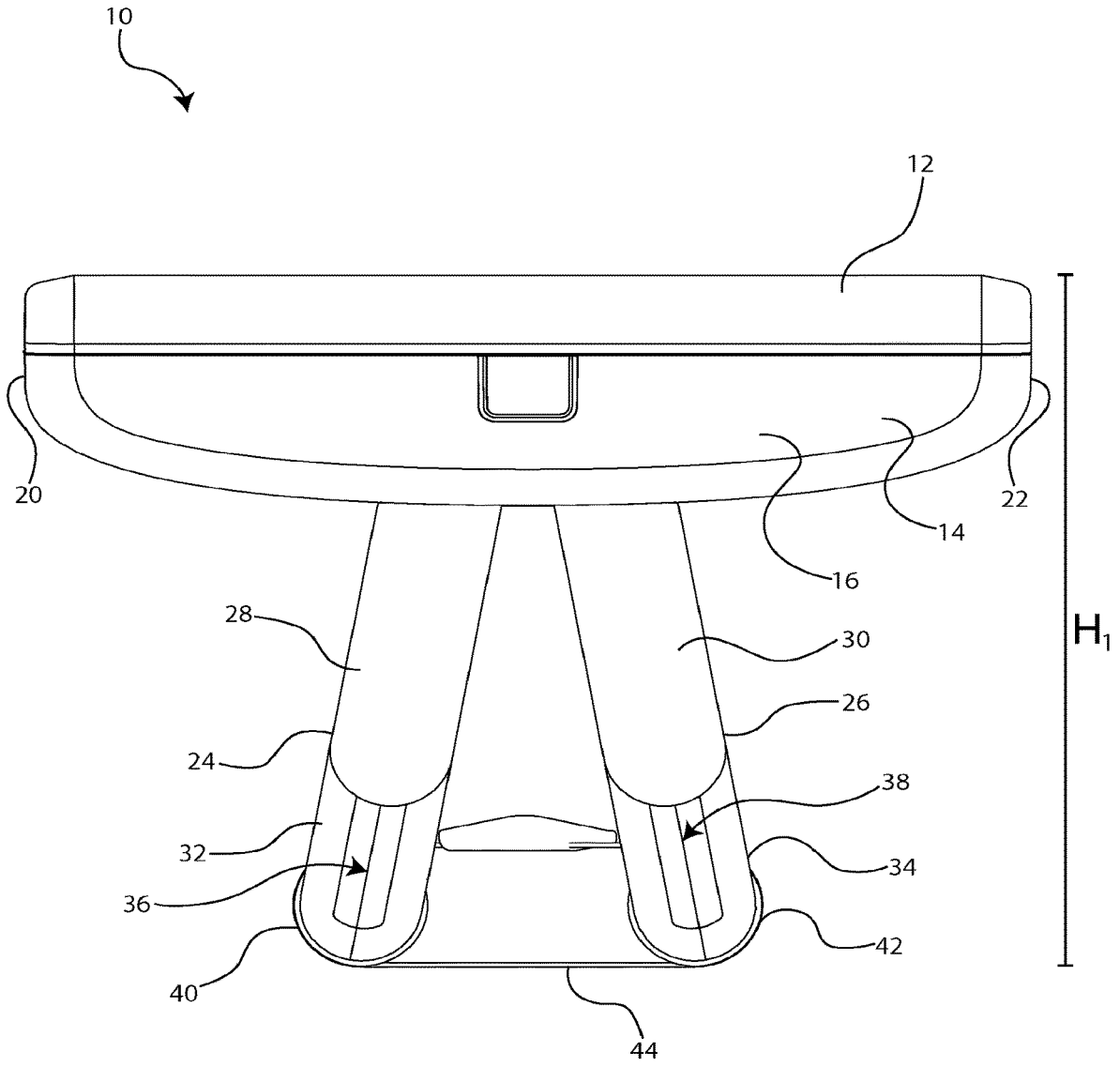
FIG. 2 is a front elevation view of the adjustable bench in a deployed configuration.

Referring to the drawings and first to FIGS. 1 and 2, there is shown a collapsible or adjustable bench 10 which, in this example, may be employed as an adjustable meditation bench or for any other suitable purpose. FIGS. 1 and 2 show the bench 10 in deployed configuration. The bench 10 generally comprises a seat 12 which, in this example, is formed of a rigid polymer with a soft elastomer insert which mates with a skirt 14. The skirt 14 extends downwardly from the seat 12. The skirt 14 has a front apron 16, a rear apron 18, and side aprons 20 and 22 which each extend between the front apron 16 and the rear apron 18. The bench 10 also has a height adjustable leg assemblies 24 and 26 which are each pivotably coupled to the skirt 14. The leg assemblies 24 and 26 each include respective upper portions 28 and 30 and respective lower portions 32 and 34. The upper portions 28 and 30 of each of the leg assemblies 24 and 26 are received by respective grooves 36 and 38 of the lower portions 32 and 34 of each of the leg assemblies 24 and 26. This allows the upper portions 28 and 30 of the leg assemblies 24 and 26 and the lower portions 32 and 34 of the leg assemblies 24 and 26 to be slidable relative to one another. The leg assemblies 24 and 26 are also each provided with respective feet 40 and 42. The feet 40 and 42 are substantially cylindrical in this example. There is an adjustable strap 44 secured about the feet 40 and 42. The adjustable strap 44 may be used to restrict movement of the leg assemblies 24 and 26 and the adjustable strap 44 may be employed as a yoga strap.

Figure 3:
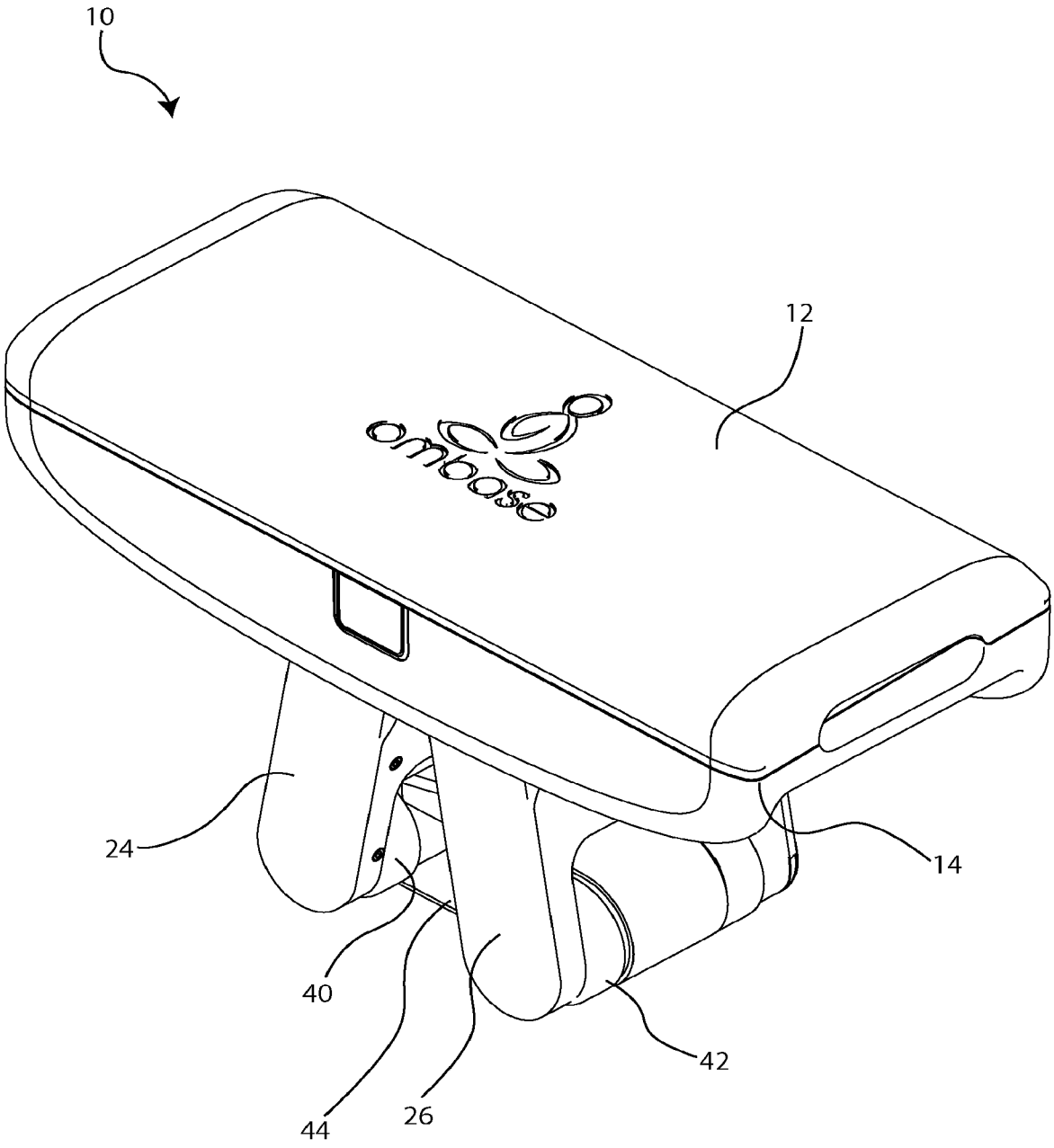
FIG. 3 is a top perspective view of a adjustable bench in a first intermediate configuration.
Figure 4:
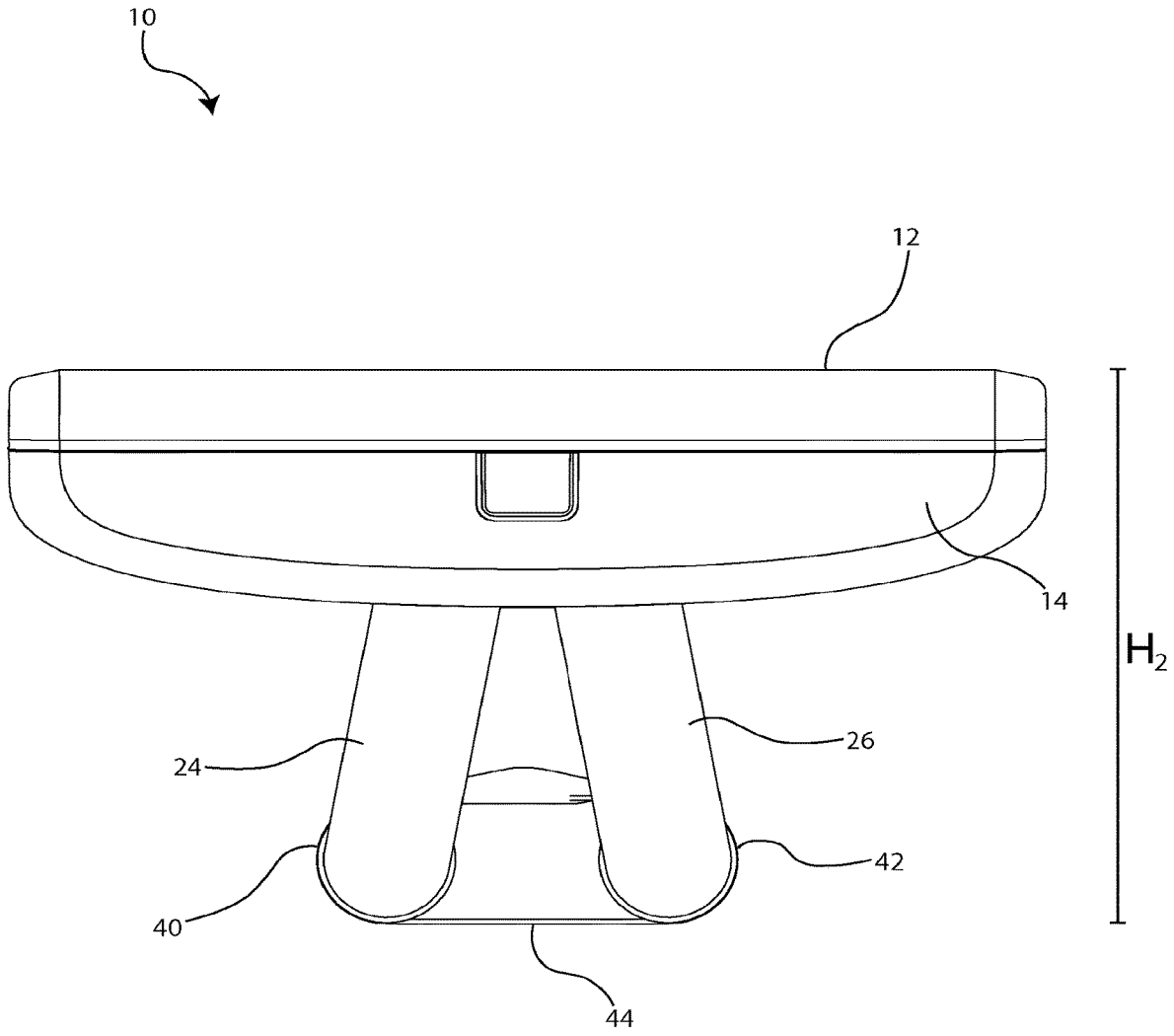
FIG. 4 is a front elevation view of the adjustable bench in the first intermediate configuration.

The leg assemblies 24 and 26 of the bench 10 are deployed in FIGS. 1 and 2 and, in this example, the bench 10 has a height $H_1$ of nine inches in the deployed configuration. There is a detent that secures the bench 10 in the deployed configuration. The adjustable strap 44 may also be used to restrict movement of the leg assemblies 24 and 26 in the deployed configuration. FIGS. 3 and 4 show the bench 10 in a first intermediate configuration. The lower portions 32 and 34 of the leg assemblies of 24 and 26 of the bench 10 are retracted in FIGS. 3 and 4 and, in this example, the bench 10 has a height $H_2$ of seven inches in the first intermediate configuration. The leg assemblies of 24 and 26 of the bench 10 are extended and retracted by between the deployed configuration and the first intermediate configuration by a button release which allows the upper portions 28 and 30 of the leg assemblies and the lower portions 32 and 34 of the leg assemblies to be slidable relative to one another. There is a detent that secures the bench 10 in the first intermediate configuration. The adjustable strap 44 may also be used to restrict movement of the leg assemblies 24 and 26. The adjustable strap 44 may also be used to restrict movement of the leg assemblies 24 and 26 in the first intermediate configuration.

Figure 5:
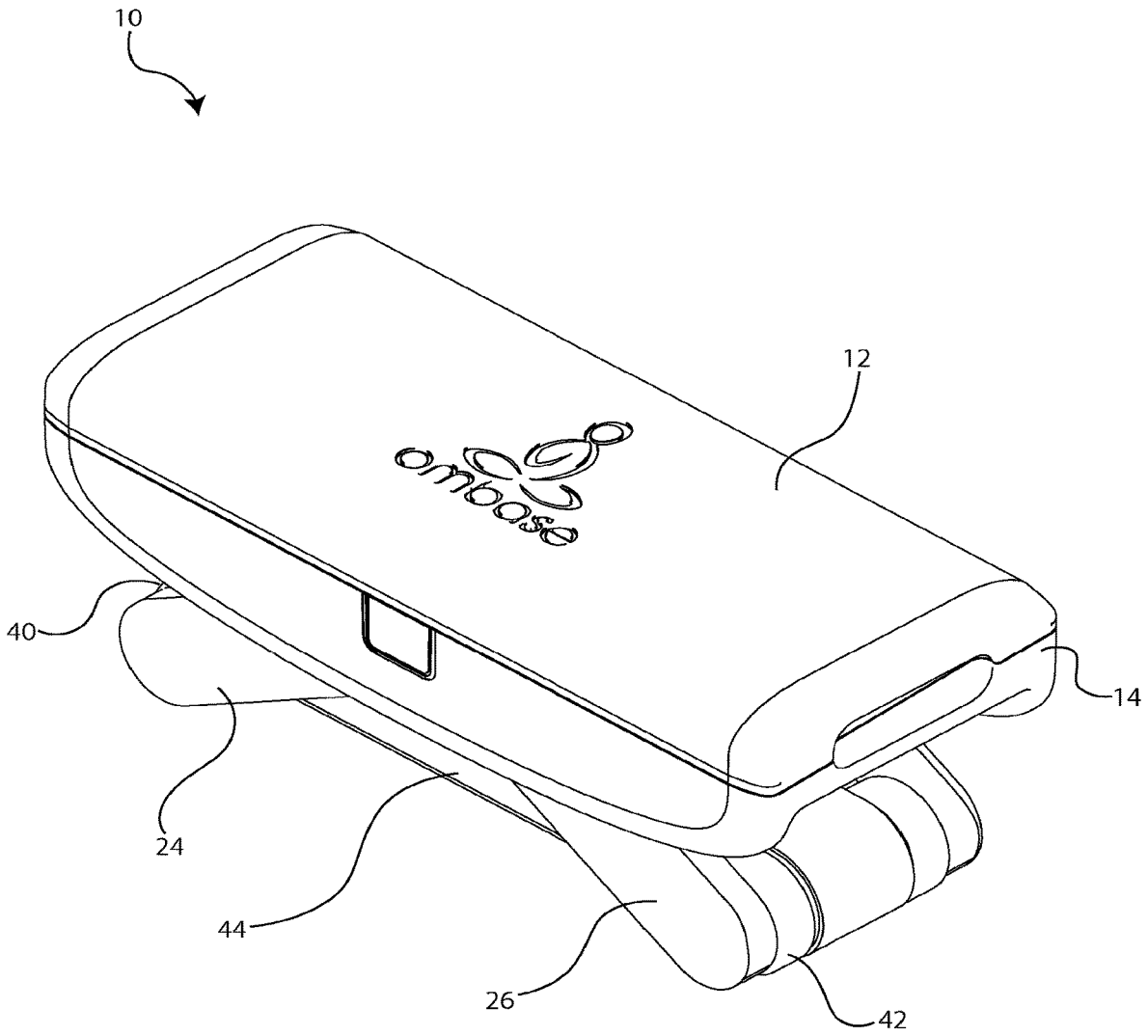
FIG. 5 is a top perspective view of the adjustable bench in a second intermediate configuration.
Figure 6:
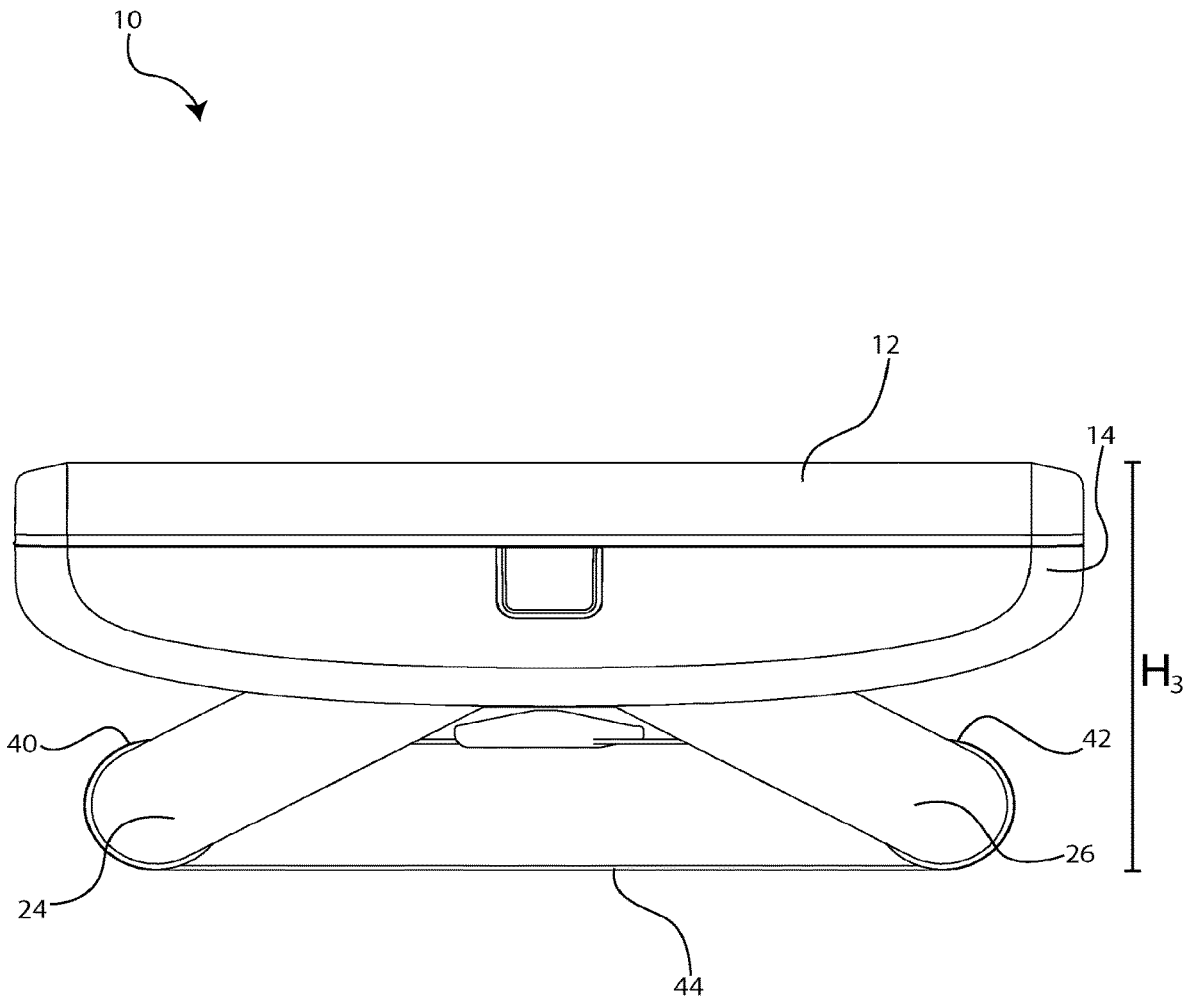
FIG. 6 is a front elevation view of the adjustable bench in the second intermediate configuration.
Figure 7A:
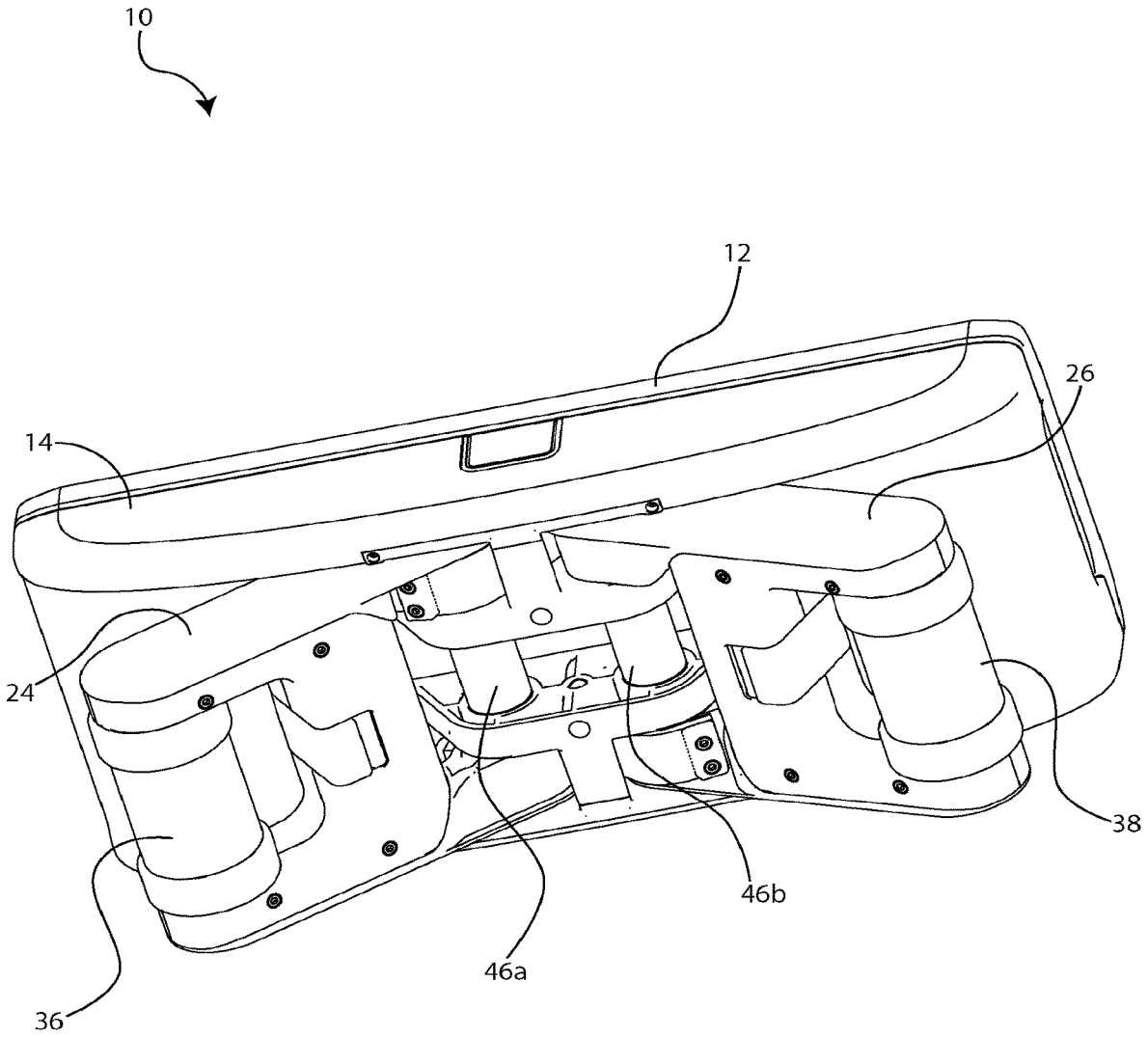
FIG. 7A is a bottom perspective view of the adjustable bench in the second intermediate configuration.
Figure 7B:
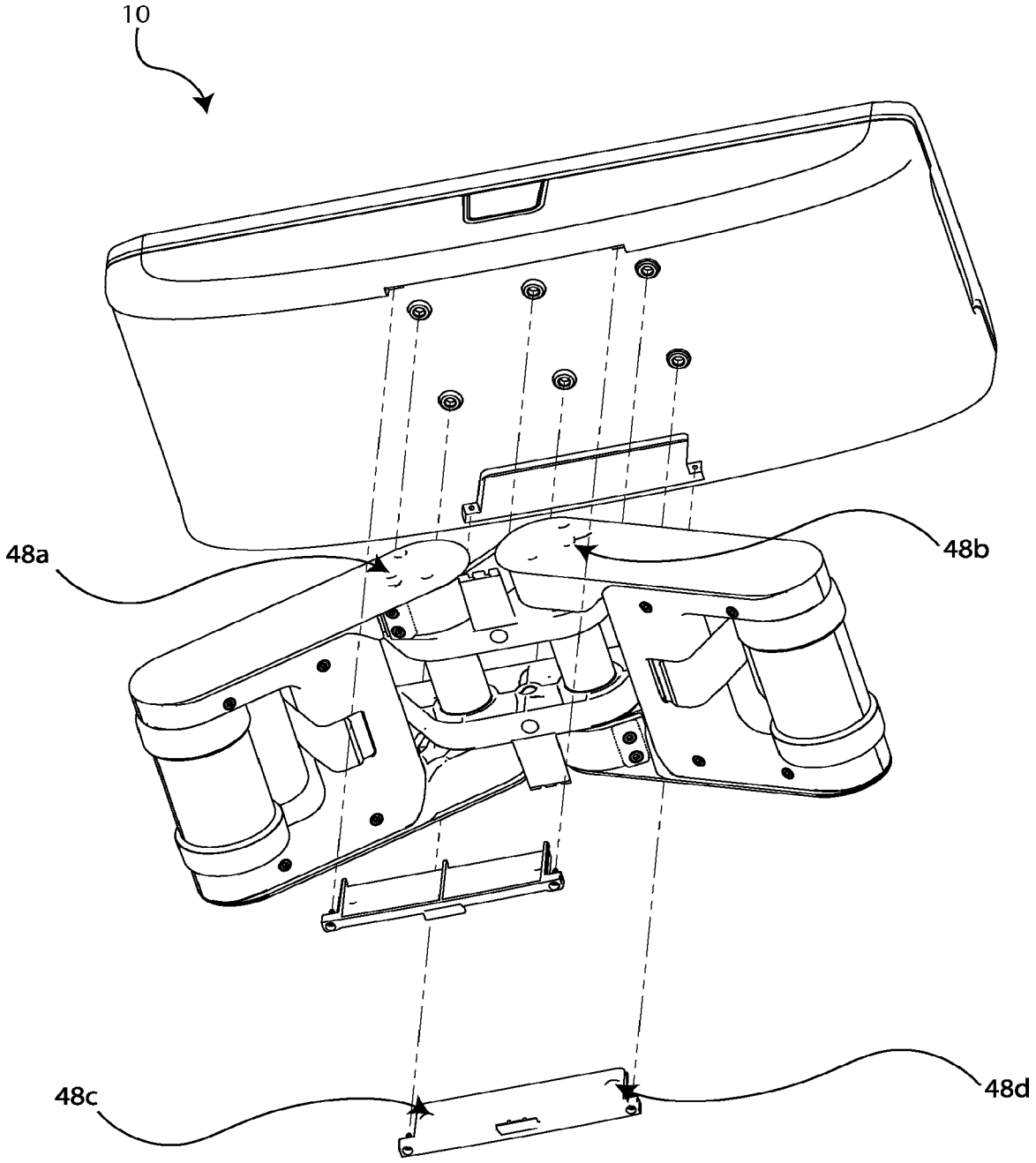
FIG. 7B is an exploded, bottom perspective view of the adjustable bench in the second intermediate configuration.

The leg assemblies 24 and 26 of the bench 10 are pivoted outwardly toward the skirt in FIGS. 5 and 6 to a second intermediate configuration and, in this example, the bench 10 has a height $H_3$ of five inches in the second intermediate configuration. The leg assemblies of 24 and 26 of the bench 10 are each mounted on respective pivot pins 46*a* and 46*b*, which are shown in FIG. 7A, and allow the leg assemblies of 24 and 26 to be pivoted between the first intermediate configuration and the second intermediate configuration. There are detents, for examples detents 48*a*, 48*b*, 48*c* and 48*d* shown in FIG. 7B, which secure the bench 10 in the second intermediate configuration. The adjustable strap 44 may also be used to restrict movement of the leg assemblies 24 and 26 in the second intermediate configuration.

Figure 8:
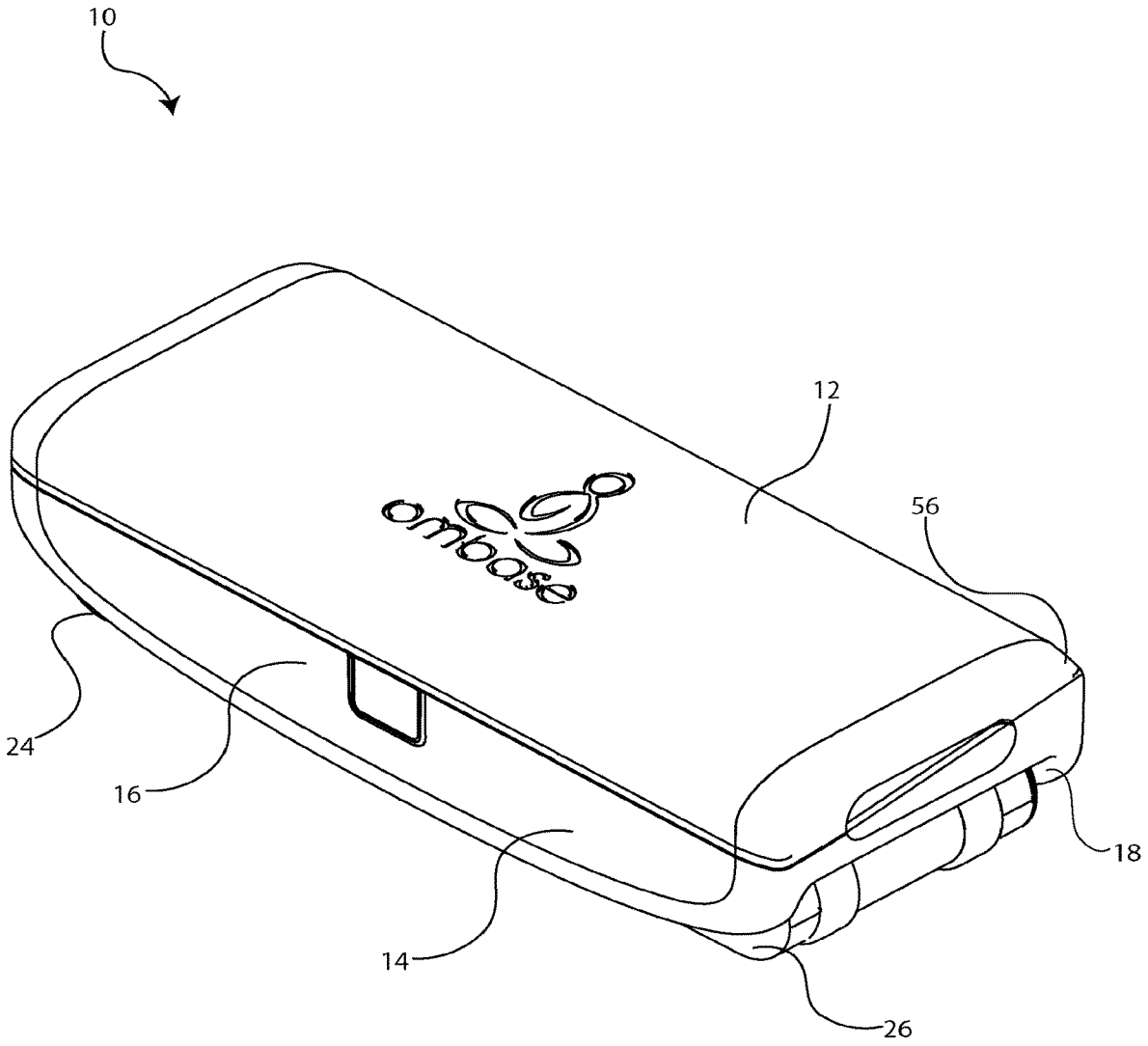
FIG. 8 is a top perspective view of the adjustable bench in a collapsed configuration showing a seat thereof a flat top surface.
Figure 9:
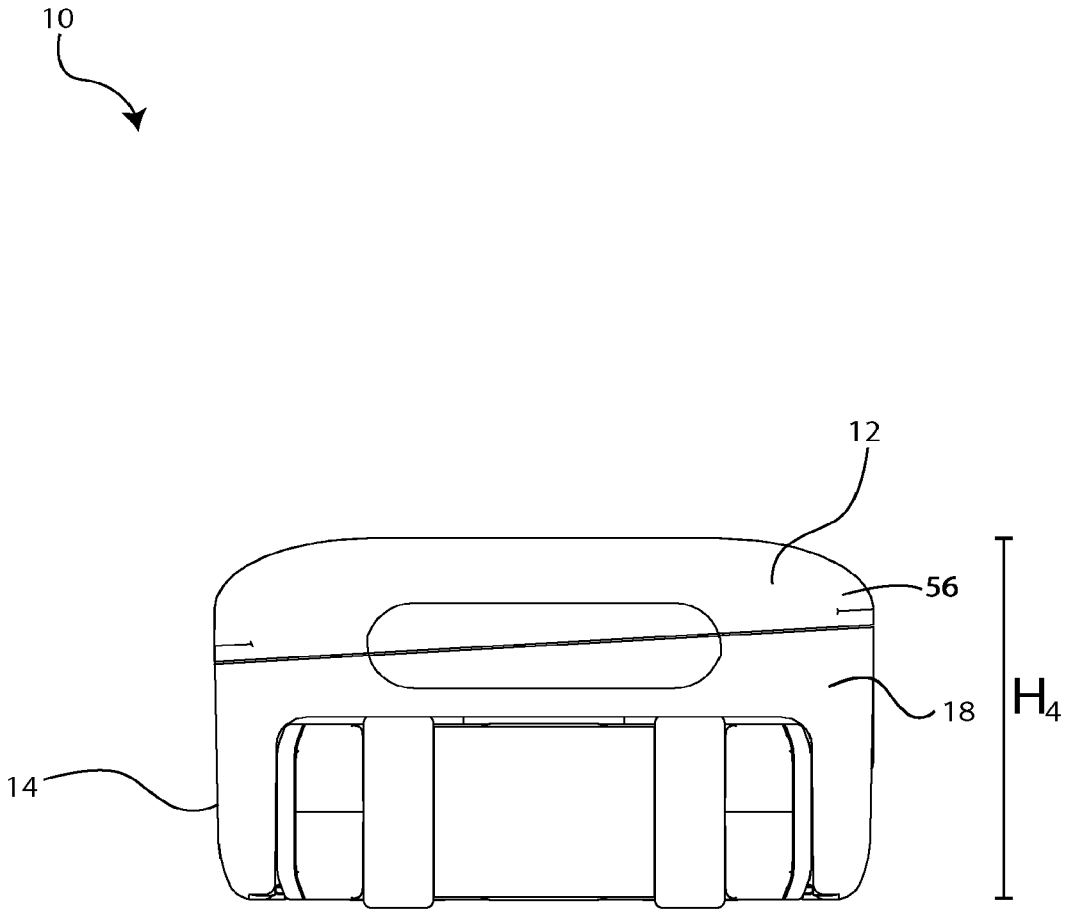
FIG. 9 is a side elevation view of the adjustable bench in the collapsed configuration showing the seat thereof with a flat top surface.

The leg assemblies 24 and 26 of the bench pivoted further outwardly toward the skirt in FIGS. 8 and 9 to a collapsed configuration and, in this example, the bench 10 has a height $H_4$ of three inches in the collapsed configuration The pivot pins 46*a* and 46*b*, which are shown in FIG. 7A, and allow the leg assemblies of 24 and 26 to be pivoted between the second intermediate configuration and the collapsed configuration. There are detents, for examples the detents 48*a*, 48*b*, 48*c* and 48*d* shown in FIG. 7B, which secure the bench 10 in the second intermediate configuration.

Figure 10:
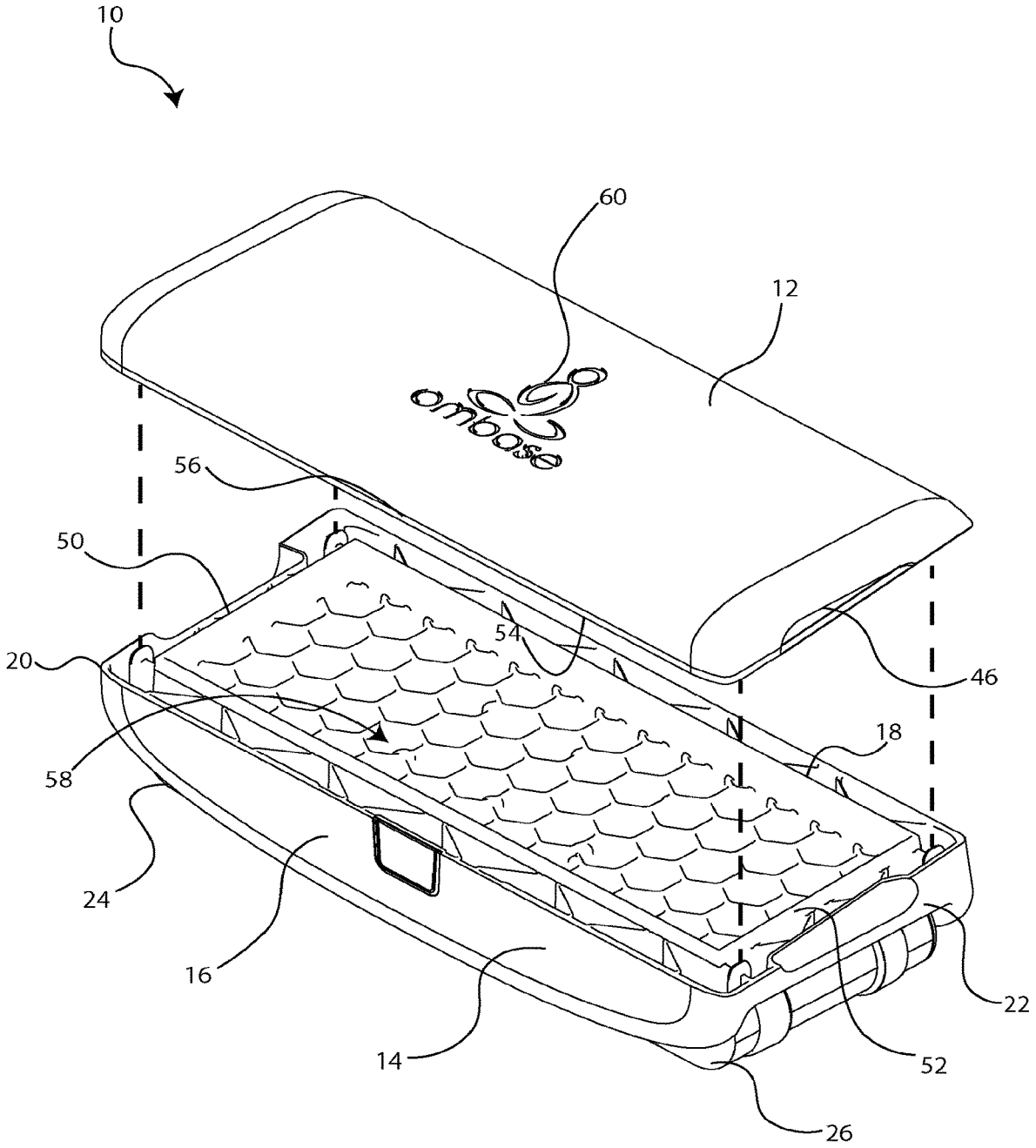
FIG. 10 is still another top perspective view of the adjustable bench in a collapsed configuration showing the seat thereof removed.
Figure 11:
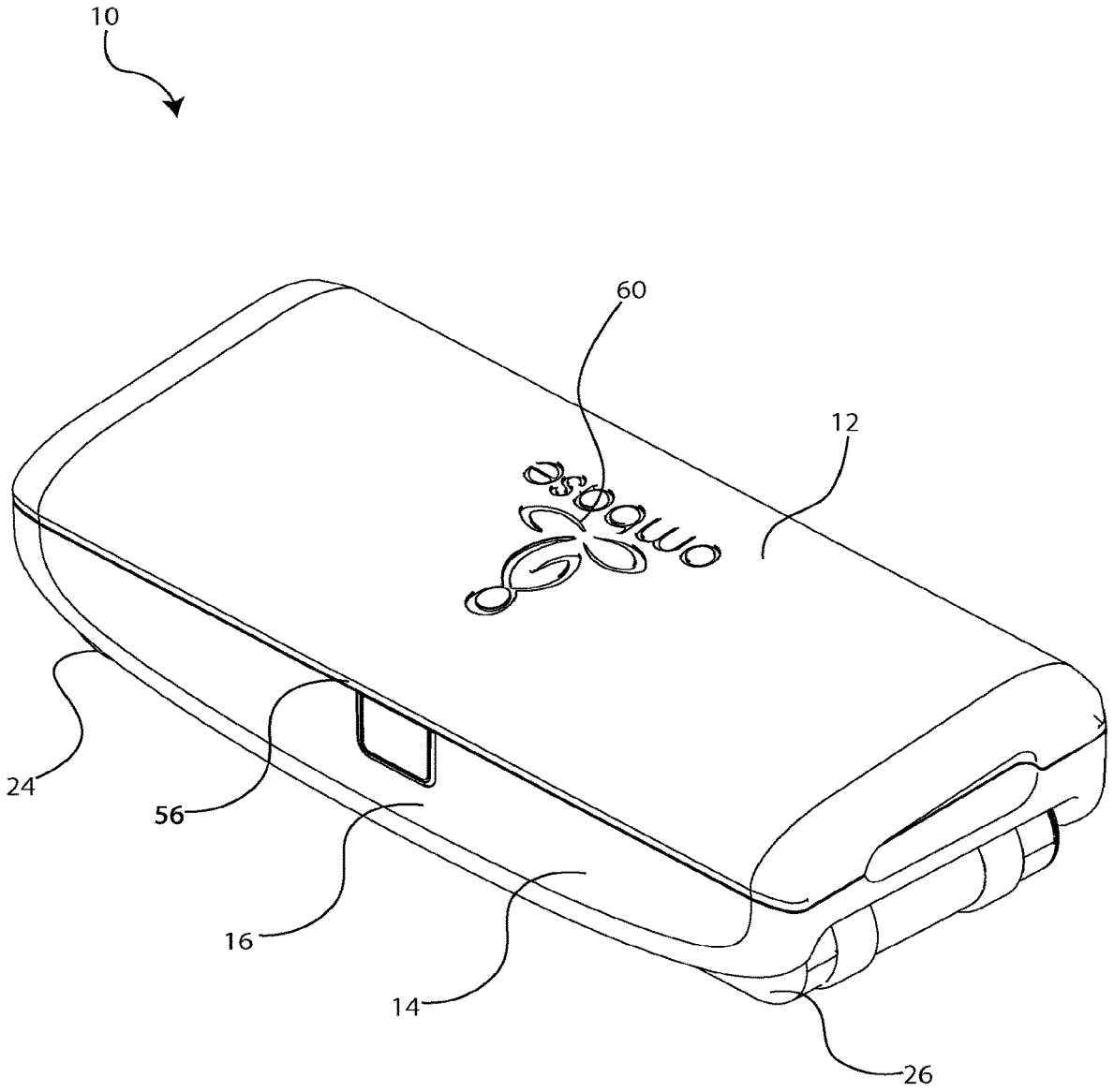
FIG. 11 is still another top perspective view of the adjustable bench in a collapsed configuration showing the seat thereof with a sloped top surface.
Figure 12:
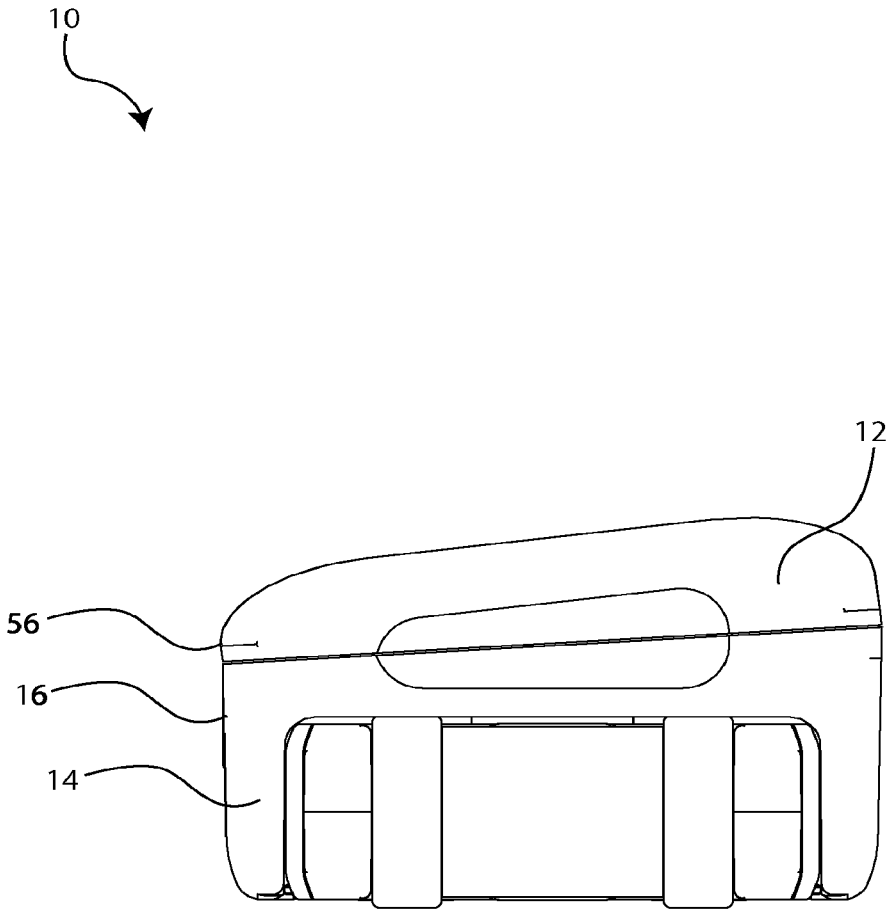
FIG. 12 is another side elevation view of the adjustable bench in the collapsed configuration showing the seat thereof with the sloped top surface.

FIG. 10 shows that the side aprons 20 and 22 of the skirt 14 each have a respective top edge 50 and 52 which slope downwardly from the rear apron 18 to the front apron 16. The seat 12 has a sloped bottom 54 which is mates with the skirt 14 of the bench 10. The seat 12 is generally wedge-shaped and has an apex 56. FIGS. 8 and 9 show the seat 12 mates with the skirt 14 of the bench 10, with the apex 56 of the seat 12 extending along the rear apron 18 of the skirt 14, so that the bench 10 has a substantially flat top surface. The seat 12 may be removed from the skirt 14 to allow access to a storage compartment 58 as shown in FIG. 10. The seat 12 may be used as a kneeling aid after it is removed. The orientation of the seat 12 may also be reversed. FIGS. 11 and 12 show the seat 12 mates with the skirt 14 of the bench 10, with the apex 56 of the seat 12 extending along the front apron 16 of the skirt 14, so that the bench 10 has an sloped top surface which, in this example, has slope of seven degrees. The seat 12 is accordingly shaped to be selectively mated with the skirt 14 to provide the bench with either a flat top surface or a sloped top surface. A logo 60 may also be embossed or printed on the seat 12 or other part of the bench 10 for advertising purposes.

It will be understood by a person skilled in the art that many of the details provided above are by way of example only, and are not intended to limit the scope of the invention which is to be determined with reference to the following claims.

What is claimed is:

1. An adjustable bench comprising:
a seat, wherein the seat is generally wedge-shaped;
a skirt, wherein the skirt includes first and second side top edges which slope downwardly from a rear of the skirt to a front of the skirt, wherein the seat is configured to be:
mated with the skirt in a first orientation to provide the bench with a flat top surface; or
mated with the skirt in a second orientation to provide the bench with a sloped top surface;
a plurality of adjustable leg assemblies coupled to the skirt; and
an adjustable strap configured to be secured to the leg assemblies to restrict movement of the leg assemblies.

2. The bench as claimed in claim 1 wherein the leg assemblies of the bench are slidably or telescopically height adjustable.

3. The bench as claimed in claim 2 wherein the leg assemblies of the bench are slidably or telescopically height adjusted to adjust a height of the seat of the bench to a deployed configuration or a first intermediate configuration.

4. The bench as claimed in claim 3, wherein the strap is configured to restrict movement of the leg assemblies when the height of the seat of the bench is adjusted to either the deployed configuration or the first intermediate configuration.

5. The bench as claimed in claim 1 wherein the seat is configured to be removed from the skirt to allow access to a storage compartment.

6. The bench as claimed in claim 1 wherein the seat is configured to be removed from the skirt and used as a kneeling aid.

7. The bench as claimed in claim 1 wherein the leg assemblies of the bench are pivotably coupled to the skirt.

8. The bench as claimed in claim 7 wherein the leg assemblies of the bench are pivoted relative to the skirt to adjust a height of the seat of the bench to a second intermediate configuration or to a collapsed configuration.

9. The bench as claimed in claim 1 wherein the seat includes an apex, and wherein:
when the seat is mated with the skirt in the first orientation, the apex extends along the rear of the skirt; and
when the seat is mated with the skirt in the second orientation, the apex extends along the front of the skirt.

10. The bench as claimed in claim 1 wherein the sloped top surface has a slope of approximately 7°.

11. A method of selectively mating a seat of an adjustable bench with a skirt of the bench, the method comprising:
mating the seat with the skirt, wherein the seat is generally wedge-shaped, the skirt includes first and second side top edges which slope downwardly from a rear of the skirt to a front of the skirt, and a plurality of adjustable leg assemblies are coupled to the skirt, wherein mating the seat with the skirt consists of one of:
mating the seat with the skirt in a first orientation to provide the bench with a flat top surface, or
mating the seat with the skirt in a second orientation to provide the bench with a sloped top surface; and
securing an adjustable strap to the leg assemblies to restrict movement of the leg assemblies.

12. The method as claimed in claim 11 wherein the leg assemblies are slidably or telescopically height adjustable to adjust a height of the seat of the bench.

13. The method as claimed in claim 12 wherein the height of the seat of the bench is adjustable to a deployed configuration or a first intermediate configuration.

14. The method as claimed in claim 13, wherein securing the strap to the leg assemblies comprises securing the strap to the leg assemblies when the height of the seat of the bench is adjusted to either the deployed configuration or the first intermediate configuration.

15. The method as claimed in claim 11 wherein the sloped top surface has a slope of approximately 7°.

16. The method as claimed in claim 11 further comprising removing the seat from the skirt to allow access to a storage compartment.

17. The method as claimed in claim 11 further comprising removing the seat from the skirt to use the seat as a kneeling aid.

18. The method as claimed in claim 11 wherein the seat includes an apex, and wherein:

mating the seat with the skirt in the first orientation comprises mating the seat with the skirt such that the apex extends along the rear of the skirt; and mating the seat with the skirt in the second orientation comprises mating the seat with the skirt such that the apex extends along the front of the skirt.

19. The method as claimed in claim 11 wherein the leg assemblies are pivotably coupled to the skirt and are pivotable to adjust a height of the seat of the bench.

20. The method as claimed in claim 19 wherein the height of the seat of the bench is adjustable to a second intermediate configuration or to a collapsed configuration.

* * * * *